US012116788B1

(12) United States Patent
Chapman et al.

(10) Patent No.: US 12,116,788 B1
(45) Date of Patent: Oct. 15, 2024

(54) ADJUSTABLE TOWER WORK PLATFORM FOR A MONOPOLE

(71) Applicant: Valmont Industries, Inc., Omaha, NE (US)

(72) Inventors: Brandon M. Chapman, Bourbon, IN (US); Clinton E. Klingerman, Plymouth, IN (US)

(73) Assignee: Valmont Industries, Inc., Omaha, NE (US)

( * ) Notice: Subject to any disclaimer, the term of this patent is extended or adjusted under 35 U.S.C. 154(b) by 403 days.

(21) Appl. No.: 16/885,368

(22) Filed: May 28, 2020

Related U.S. Application Data

(60) Provisional application No. 62/858,361, filed on Jun. 7, 2019.

(51) Int. Cl.

| | |
|---|---|
| ***E04G 5/06*** | (2006.01) |
| ***E04G 1/12*** | (2006.01) |
| ***E04G 1/15*** | (2006.01) |
| ***E04G 3/24*** | (2006.01) |

(52) U.S. Cl.
CPC ..... *E04G 1/12* (2013.01); *E04G 1/15* (2013.01); *E04G 3/243* (2013.01); *E04G 5/061* (2013.01)

(58) Field of Classification Search
CPC ..... E04G 1/12; E04G 5/061; E04G 3/243; H01Q 1/1242
See application file for complete search history.

(56) References Cited

U.S. PATENT DOCUMENTS

| | | | | |
|---|---|---|---|---|
| 5,467,955 | A * | 11/1995 | Beyersmith | H01Q 1/1242 343/890 |
| 5,787,673 | A * | 8/1998 | Noble | H01Q 1/1242 52/114 |
| 5,954,305 | A * | 9/1999 | Calabro | H01Q 1/1242 343/890 |
| 6,028,566 | A * | 2/2000 | Pennell | H01Q 1/246 248/219.3 |
| 6,563,475 | B2 * | 5/2003 | Ianello | H01Q 1/1242 343/890 |
| 6,710,751 | B2 * | 3/2004 | Ianello | H01Q 1/1242 343/890 |
| 6,856,302 | B2 * | 2/2005 | Gonçalves et al. | H01Q 1/1207 343/890 |
| 10,526,803 | B2 * | 1/2020 | Franceschino | E04G 5/067 |

(Continued)

*Primary Examiner* — Jessica L Laux
*Assistant Examiner* — Kathleen M. McFarland
(74) *Attorney, Agent, or Firm* — Milligan PC LLO

(57) ABSTRACT

The present invention provides an adjustable tower platform for attachment to a monopole. According to a preferred embodiment, the present invention includes a first, second and third exterior face pipes which are attached together at each end to support one or more corner platforms. According to further preferred embodiments, the present invention includes a first, second and third corner platforms which are attached between each pair of face pipes by angle brackets. According to a further preferred embodiment, each of the corner platforms are preferably undergirded by side arm joists which are further connected to central connection plates. According to a further preferred embodiment, the invention preferably further includes a first, second and third connection plates which are bolted together to form a ring mount which suspends the tower platform on a monopole at a given height.

23 Claims, 13 Drawing Sheets

(56) References Cited

U.S. PATENT DOCUMENTS

| | | | | |
|---|---|---|---|---|
| 2002/0053996 | A1* | 5/2002 | Ianello | H01Q 1/1242 343/890 |
| 2003/0189527 | A1* | 10/2003 | Goncalves | H01Q 1/1242 343/890 |
| 2003/0205021 | A1* | 11/2003 | Ryan | E04C 3/30 52/834 |
| 2004/0011592 | A1* | 1/2004 | Lee | E04G 3/243 182/187 |
| 2004/0032375 | A1* | 2/2004 | Ianello | H01Q 1/1242 343/890 |
| 2009/0095569 | A1* | 4/2009 | Cooper | A01M 31/02 182/187 |
| 2013/0098709 | A1* | 4/2013 | Miller | E04G 3/243 182/83 |
| 2015/0152653 | A1* | 6/2015 | Dolan | E04G 1/36 182/113 |
| 2016/0330951 | A1* | 11/2016 | Hillis | E06C 1/10 |
| 2017/0211745 | A1* | 7/2017 | Alban | F16M 13/022 |
| 2018/0254545 | A1* | 9/2018 | Hendrix | H01Q 21/0025 |
| 2019/0348742 | A1* | 11/2019 | Palmer | H01Q 1/1228 |
| 2019/0352921 | A1* | 11/2019 | Takemoto | B32B 15/20 |
| 2020/0123790 | A1* | 4/2020 | de La Soujeole | E04G 5/14 |
| 2022/0085481 | A1* | 3/2022 | Severin | H01Q 1/42 |

* cited by examiner

ADJUSTABLE TOWER WORK PLATFORM FOR A MONOPOLE

FIELD OF INVENTION

The present invention is related in general to tower platforms and, in particular, to an adjustable tower platform for use with a monopole.

BACKGROUND OF THE INVENTION

Large platforms are often used for work conducted at various elevations (generally above 10-15 feet). These elevated platforms however quickly become cost prohibitive and can require significant time to build. One alternative to building a platform is the use of an extendable hydraulic lift. These types of platforms are very quick and easy to use. However, they are also very expensive and can only provide a limited amount of additional working height. Further, these types of lifts require flat surfaces and/or road access.

Monopole platforms provide a further solution to working at extended heights. Monopole platforms provide a center support ring which is placed around a center monopole. Platform structures are then attached to the center support ring to allow loads to be transferred to the monopole. While helpful, current ring mount designs often, due to their shape and size, cause damage to the monopoles. Further, current ring mount designs can be exceedingly heavy and can have large wind areas making them dangerous to use in a variety of conditions.

In order to overcome the limitations of the prior art, a monopole platform design is needed which is able to evenly distribute weight around the monopole without causing damage. Further, a system is needed which is lighter and easier to use than current monopole designs.

SUMMARY OF THE DISCLOSURE

The present invention provides an adjustable tower platform for attachment to a monopole. According to a preferred embodiment, the present invention includes a first, second and third exterior face pipes which are attached together at each end to support one or more corner platforms.

According to further preferred embodiments, the present invention includes a first, second and third corner platforms which are attached between each pair of face pipes by angle brackets.

According to a further preferred embodiment, each of the corner platforms are undergirded by side arm joists which are further connected to central connection plates.

According to a further preferred embodiment, the invention further includes first, second and third connection plates which are bolted together to form a ring mount which suspends a tower platform on a monopole at a given height.

Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

BRIEF DESCRIPTION OF THE DRAWINGS

Elements in the figures have not necessarily been drawn to scale in order to enhance their clarity and to improve the understanding of the various elements and embodiments of the invention. Furthermore, elements that are known to be common and well understood to those in the industry are not depicted in order to provide a clear view of the various embodiments of the invention. Thus, it should be understood that the drawings are generalized in form in the interest of clarity and conciseness.

DETAILED DESCRIPTION OF THE DRAWINGS

Reference is now made in detail to the exemplary embodiments of the invention, examples of which are illustrated in the accompanying drawings. Wherever possible, the same reference numbers will be used throughout the drawings to refer to the same or like parts. The description, embodiments and figures are not to be taken as limiting the scope of the claims.

It should also be understood that throughout this disclosure, unless logically required to be otherwise, where a process or method is shown or described, the steps of the method may be performed in any order, repetitively, iteratively or simultaneously. As used throughout this application, the word "may" is used in a permissive sense (i.e., meaning "having the potential to'), rather than the mandatory sense (i.e. meaning "must"). Further, words using the singular or plural number also include the plural or singular number respectively. Additionally, the words, 'herein,' 'hereunder,' 'above,' 'below,' and words of similar import refer to this application as a whole and not to any particular portions of this application. When the word 'or' is used in reference to a list of two or more items, that word covers all of the following interpretations of the word: any of the items in the list, all of the items in the list and any combinations of the items in the list.

Any examples or illustrations given herein are not to be regarded in any way as restrictions on, limits to, or express definitions of, any term or terms with which they are utilized. Instead, these examples or illustrations are to be regarded as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Further, various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
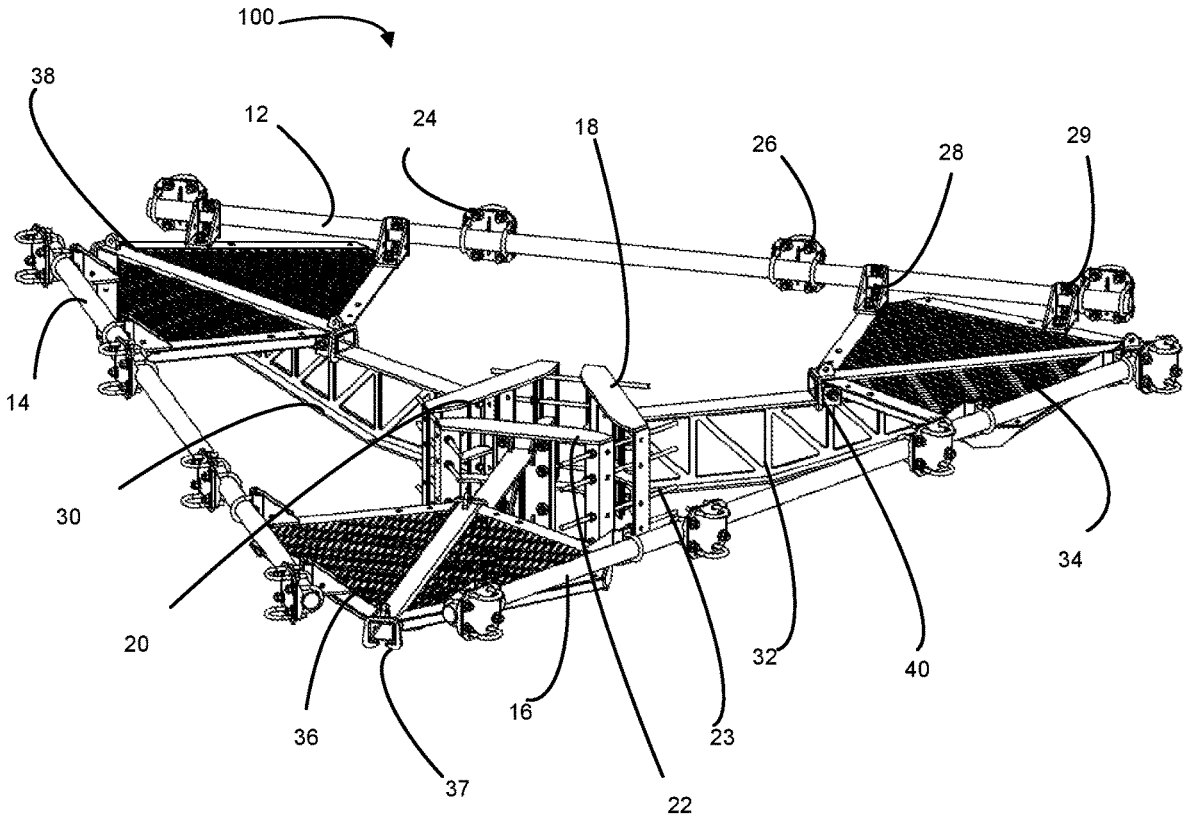
FIG. 1 illustrates a perspective view of an adjustable, monopole platform in accordance with a first preferred embodiment of the present invention.

FIG. 1 illustrates a perspective view of an adjustable, monopole platform 100 in accordance with a first preferred embodiment of the present invention. As shown, the exemplary monopole platform 100 of the present invention may preferably include three face pipes 12, 14, 16 which are secured together via three corner platforms 34, 36, 38 (as discussed further below) to form a generally triangular shape. According to preferred embodiments, the face pipes 12, 14, 16 may be formed of structural steel or galvanized pipe which may preferably be 2⅞" by 150". According to alternative preferred embodiments, the face pipes 12, 14, 16 may alternatively be formed of any rigid material and may be of any diameter and/or length.

Figure 6:
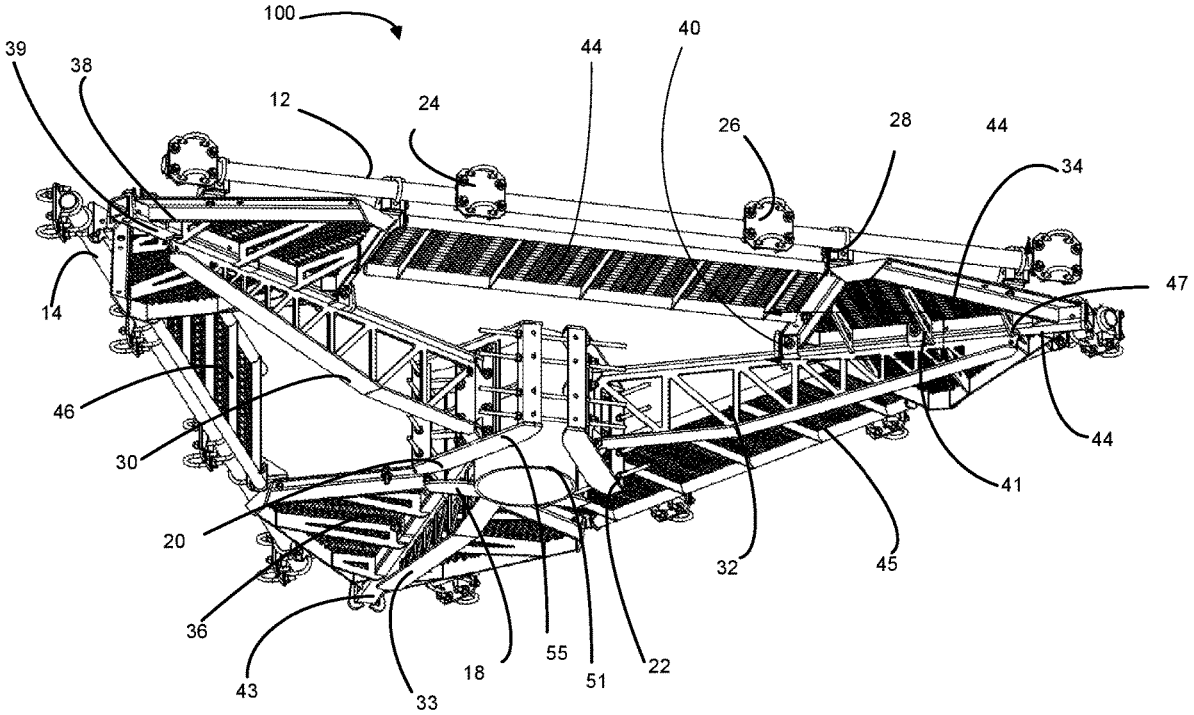
FIG. 6 illustrates a bottom perspective view of the monopole platform shown in FIG. 5

As further shown in FIGS. 1 and 6, the corner platforms 34, 36, 38 are preferably undergirded by respective side arm joists 32, 30, 33. As further shown in FIGS. 1 and 6, each side arm joist 32, 30, 33 is respectively secured at a first distal end to the underside of each respective corner platform 34, 36, 38 via a one or more corner angle brackets 40, 41 as discussed further below. According to preferred embodiments of the present invention, each side arm joist 32, 30, 33 may preferably be formed as a tapered truss I-Beam. Still further, the interior ends of each side arm joist 32, 30, 33 are preferably each secured to a respective central connection plate 18, 20, 22 via one or more connection bolts 23 as discussed further below. As further shown in FIG. 1, each face pipe 12, 14, 16 is further attached to multiple cross-over plates 24, 26. Still further, each face pipe 12, 14, 16 as shown is further attached at each end to a pair of corner platforms 34, 36, 38 by multiple face pipe connection brackets 28, 29. As shown, the central arm joists 30, 32, 33 may be formed of a single joist frame or may include a central joist section 39, 43, 47 integrated within the frame of each respective corner platform 34, 36, 38. As further shown, the central arm joists 30, 32, 33 are preferably orientated so that the front axis of each central joist arm 30, 32, 33 (i.e., the outward facing direction of each distal end surface 37 (see also element 933 shown in FIG. 12)) is oriented away from any face pipe 12, 14, 16.

Figure 1A:
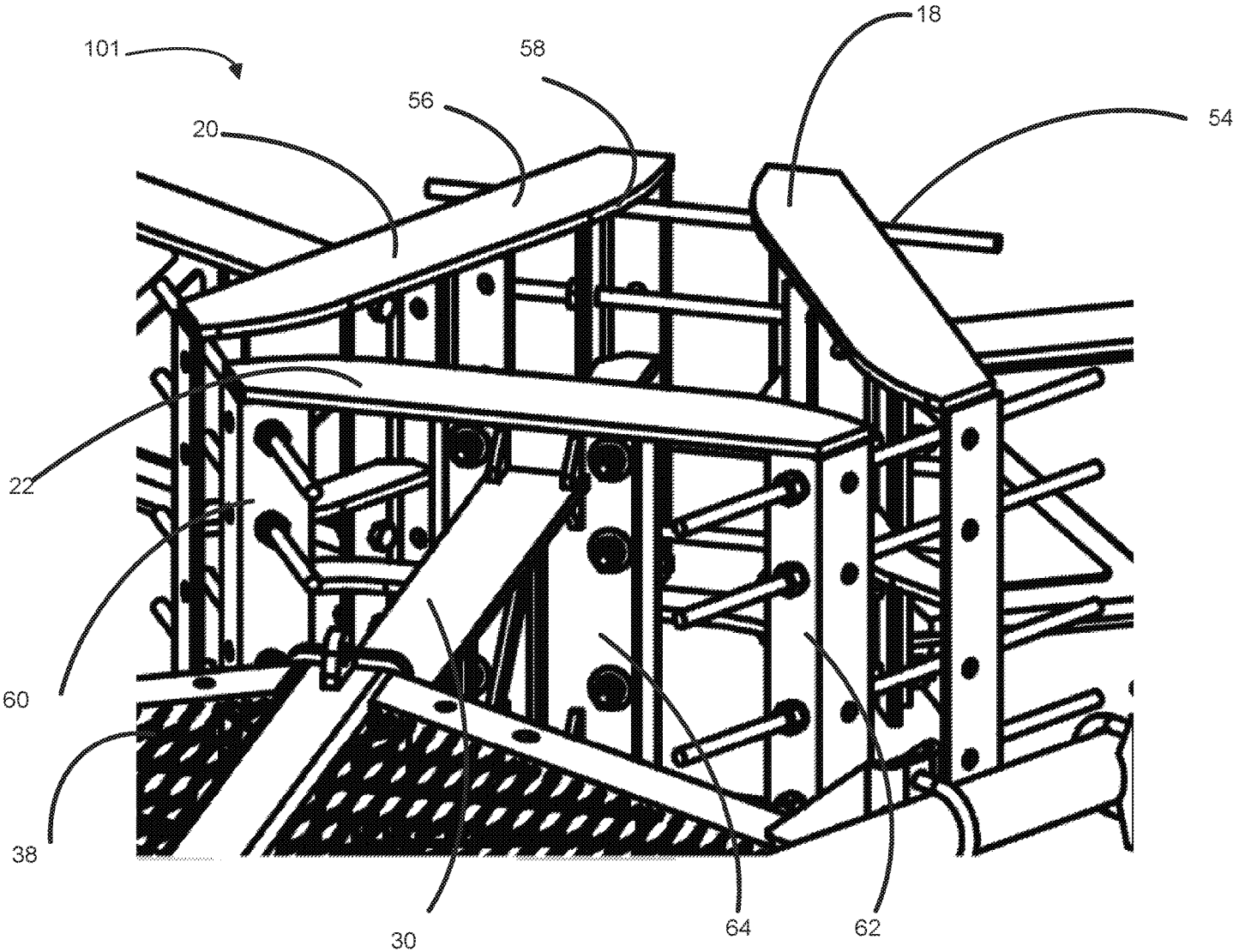
FIG. 1A provides a detailed view of the ring mount shown in FIG. 1.

As further shown in FIGS. 1 and 6, and in more detail in FIG. 1A, the central connection plates 18, 20, 22 are preferably interconnected to form a single ring mount 101 which may be secured to a monopole. According to preferred embodiments, the ring mount 101 of the present invention provides a frictional fit to suspend the monopole platform 100 at a given height while providing a load transfer that spreads the applied load of the monopole platform more evenly onto the surface of a monopole.

Figure 4:
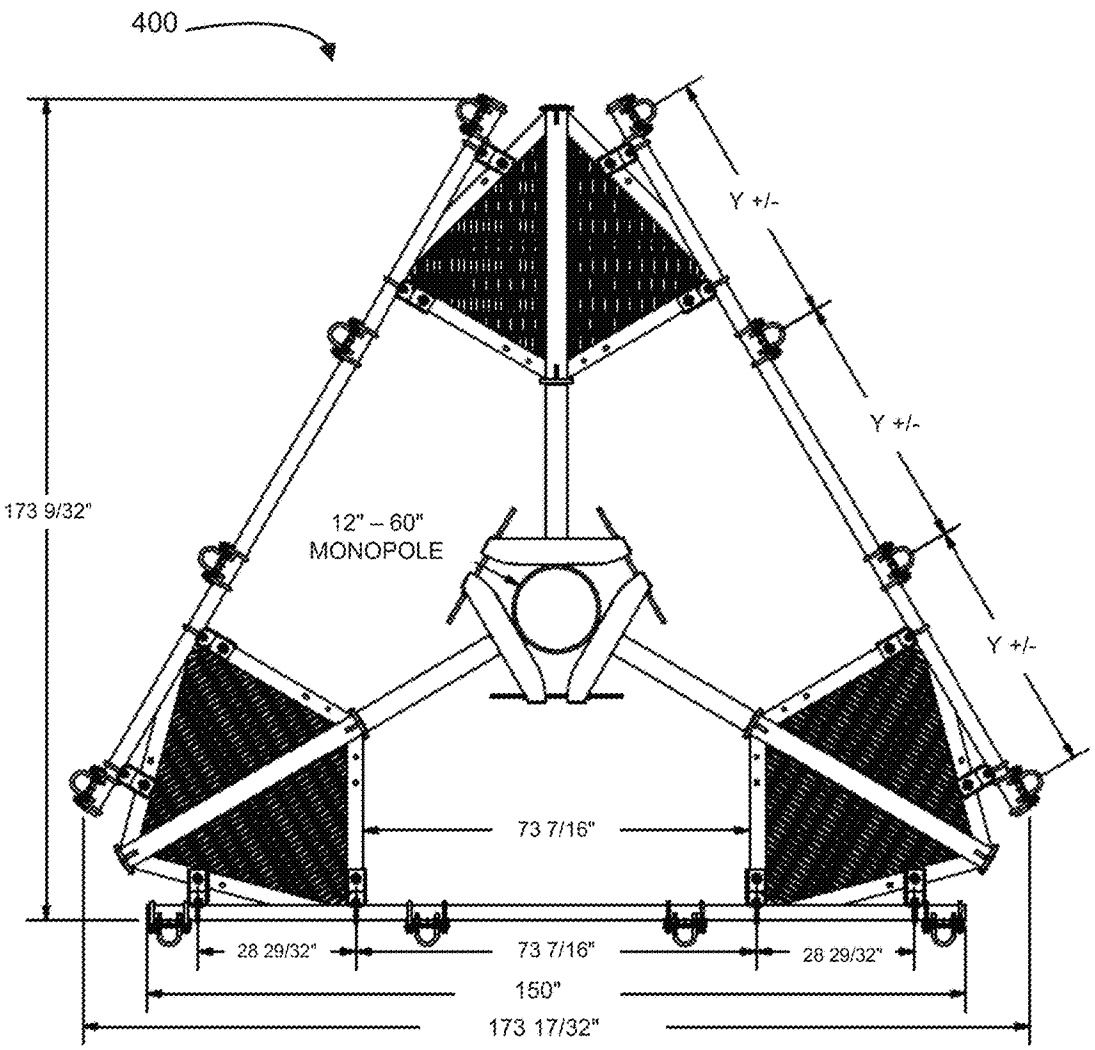
FIG. 4 illustrates a top view of the monopole platform show in FIG. 1.

FIG. 1A provides a more detailed view of the ring mount 101 of the present invention. As shown in FIG. 1A, each central connection plate 18, 20, 22 is preferably formed of a top surface 56 and a bottom surface 55 (shown in FIG. 6) each having rounded front surfaces 58. Further, each central connection plate 18, 20, 22 preferably further includes a left mounting post 60, a central mounting post 64 and a right mounting post 62. As shown, the central mounting post 64 preferably secures a side arm joist 30 which in turn is connected to a corner platform 38. As further shown, the left and right mounting posts 60, 62 preferably further include multiple perforations for receiving connection bolts 54 which as shown secure each right mounting post 60 of each respective central connection plate 18, 20, 22 to the left mounting post 62 of the next/adjacent central connection plate 18, 20, 22. In this way, the connection bolts 54 may provide tension to force the front surfaces of each weldment 18, 20, 22 into frictional contact with a central monopole 51. FIG. 4 illustrates a top view 400 of the monopole platform show in FIG. 1 which is secured to a central monopole. According to preferred embodiments of the present invention, the monopole platform of the present invention may be connected to monopoles have a variety of diameters. For example, the monopole platform of the present invention may be connected to monopoles having any diameter between 12" and 60".

Figure 2:
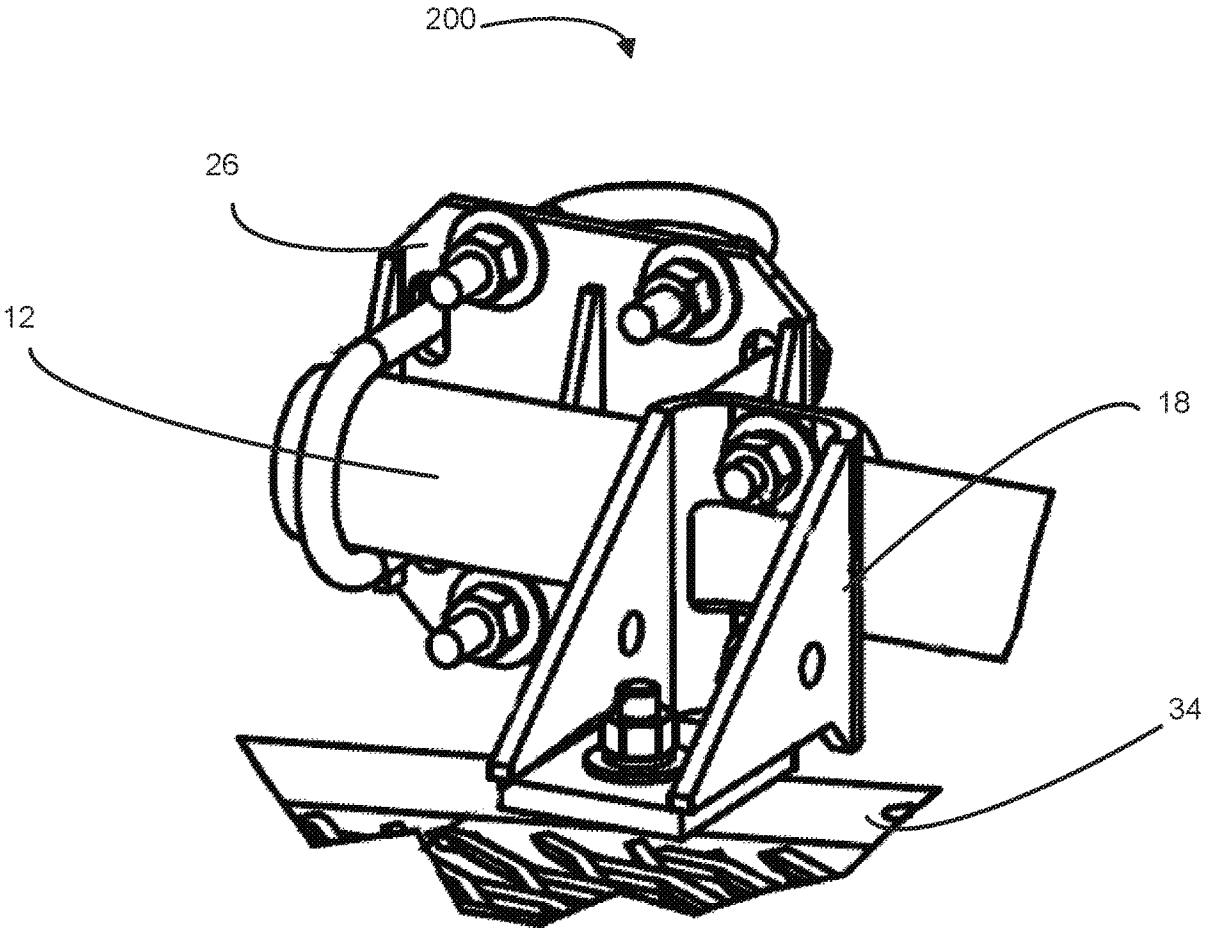
FIG. 2 illustrates a face pipe connection bracket in accordance with a further preferred embodiment of the present invention.
Figure 3:
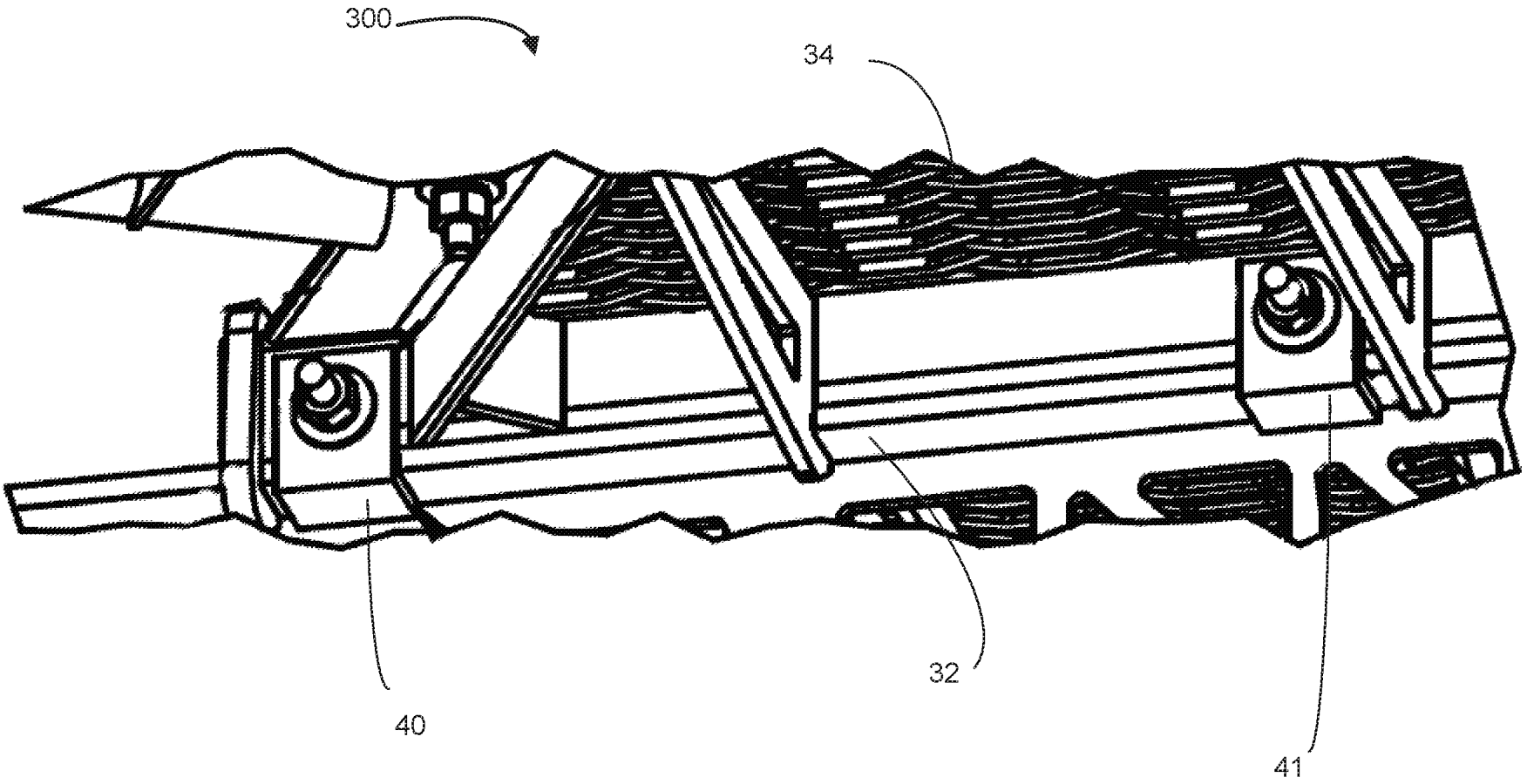
FIG. 3 illustrates a corner angle bracket in accordance with a further preferred embodiment of the present invention.

FIG. 2 provides a detailed view 200 illustrating the connection of a face pipe 12 to a cross-over plate 26 and to a corner platform 34 via a face pipe connection bracket 18 in accordance with a further preferred embodiment of the present invention. Further, FIG. 3 provides a detailed view 300 illustrating the underside attachment of a side arm joist 32 to a corner platform 34 via a pair of corner angle brackets 40, 41 in accordance with a further preferred embodiment of the present invention.

Figure 5:
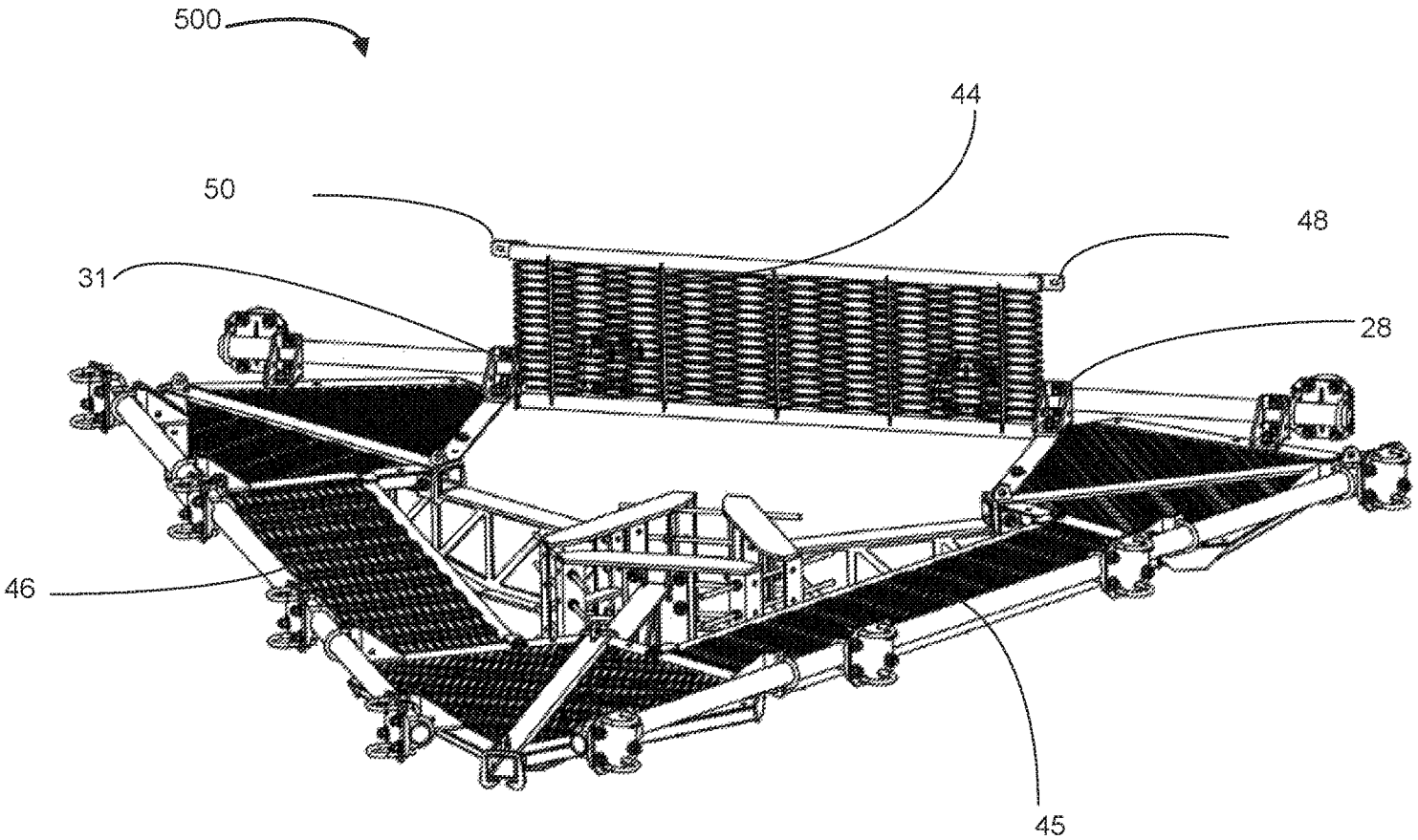
FIG. 5 illustrates a further perspective view of the monopole platform of the present invention with further platform sections attached.
Figure 7:
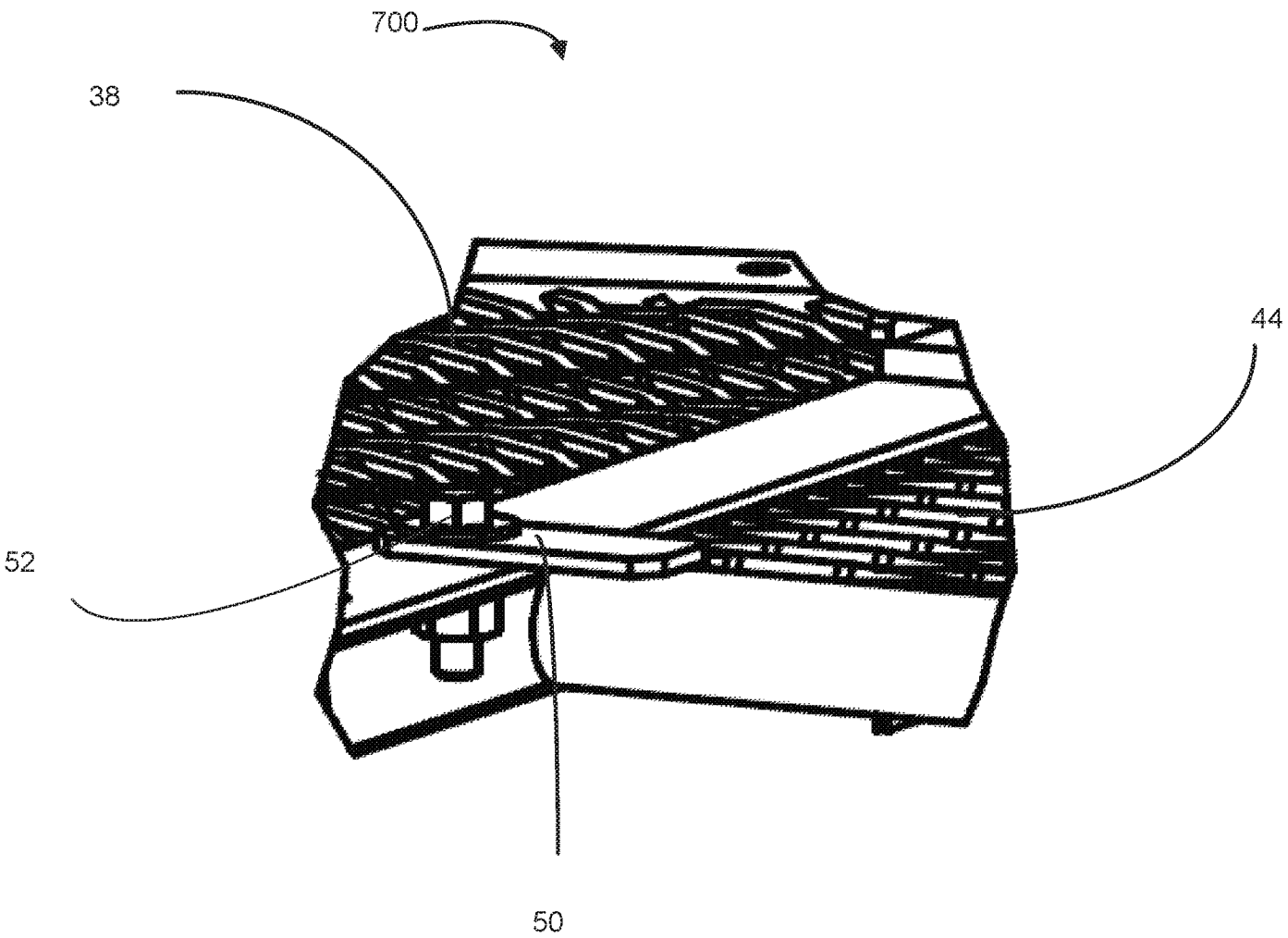
FIG. 7 illustrates a detailed view of a first connection point for a platform section of the present invention.
Figure 8:
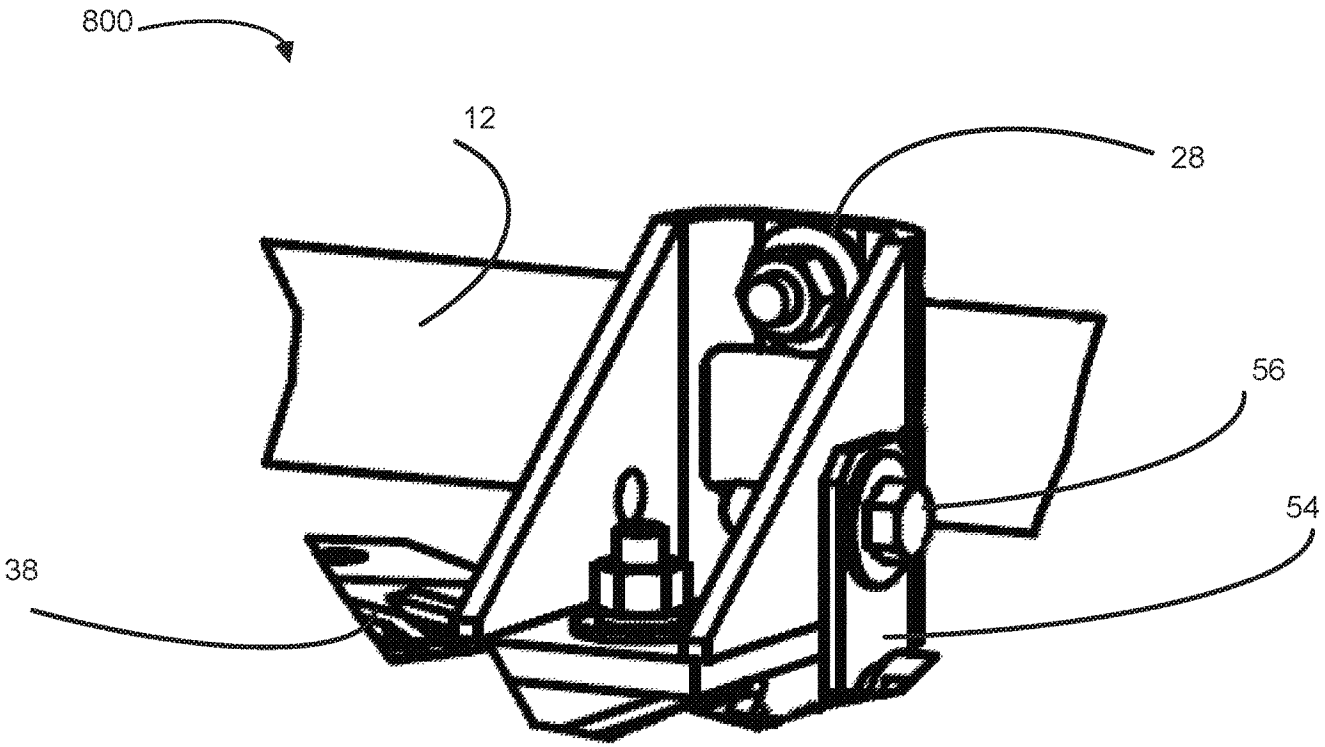
FIG. 8 illustrates a detailed view of a face pipe connection bracket and a second connection point for a platform section of the present invention.

FIG. 5 illustrates a further perspective view of the monopole platform 500 of the present invention with platform sections 44, 45, 46 attached to the platform 500. As shown, each platform section 44, 45, 46 may preferably be secured with a pair of platform securing flanges 50, 48 (as shown in FIG. 7) and further rotationally attached to a pair of face pipe connection brackets 28, 31 (as shown in FIG. 8 below). FIG. 6 further provides a bottom perspective view of the monopole platform 100 shown in FIG. 5 and as discussed with reference to FIG. 1 above.

FIG. 7, illustrates a detailed view of a first connection point 700 for a platform insert 44 of the present invention. As shown in FIG. 7, a platform insert 44 may be secured to a corner platform 38 via a platform securing flange 50 which is secured with a bolt 52. Further, FIG. 8 illustrates a second connection point 800 for a platform insert 44 (shown in FIGS. 6-7) of the present invention. As shown, a platform insert (shown in FIGS. 6-7) may be rotationally attached to a corner platform 38 and a face pipe 12 via a face pipe connection bracket 28. According to a further preferred embodiment, the connection may preferably be made via a flange 54 which is rotationally secured to the face pipe connection bracket 28 via a securing bolt 56.

Figure 9:
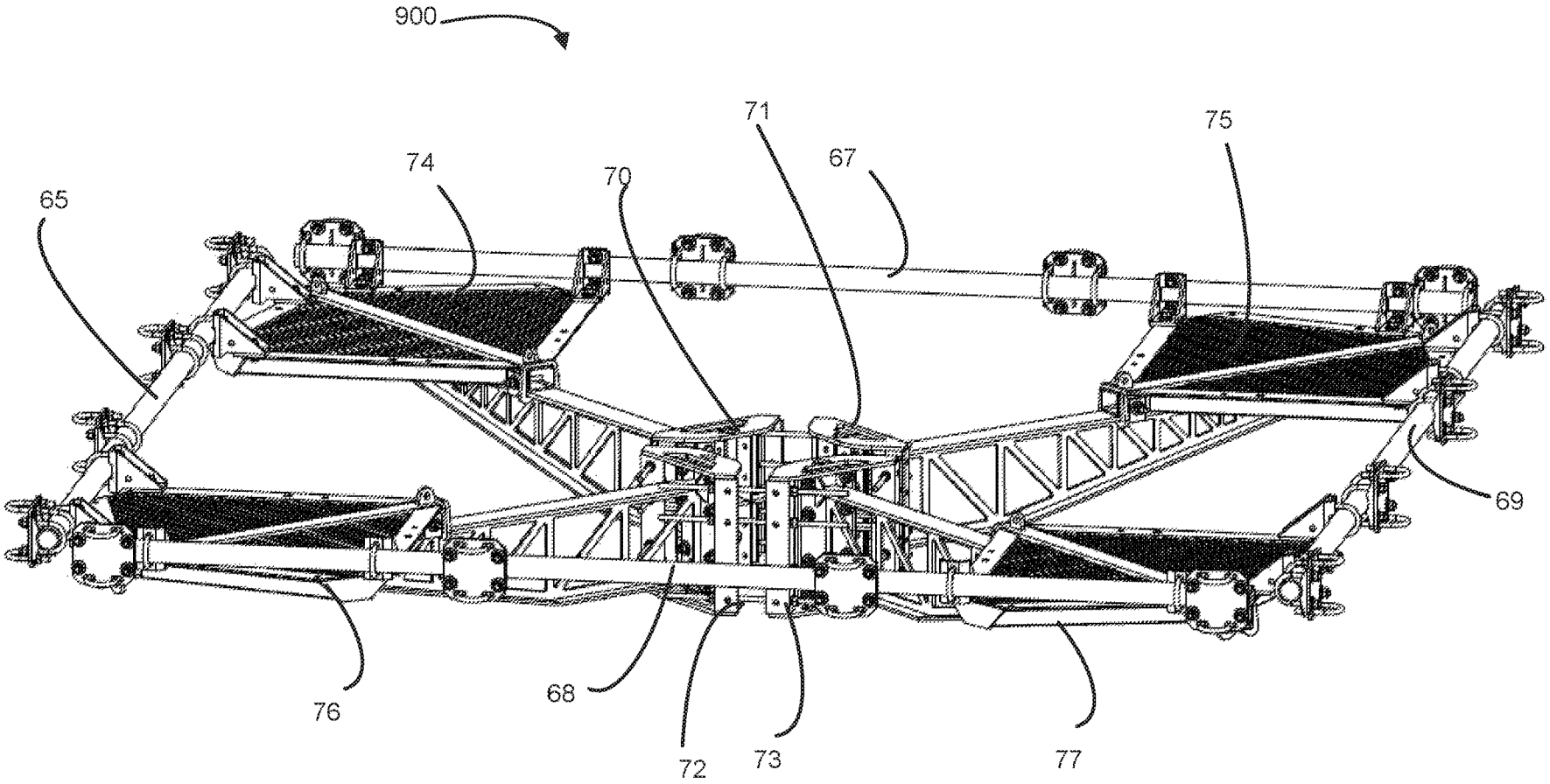
FIG. 9 illustrates a detailed view an alternative monopole platform design of the present invention having four corner platform sections.
Figure 10:
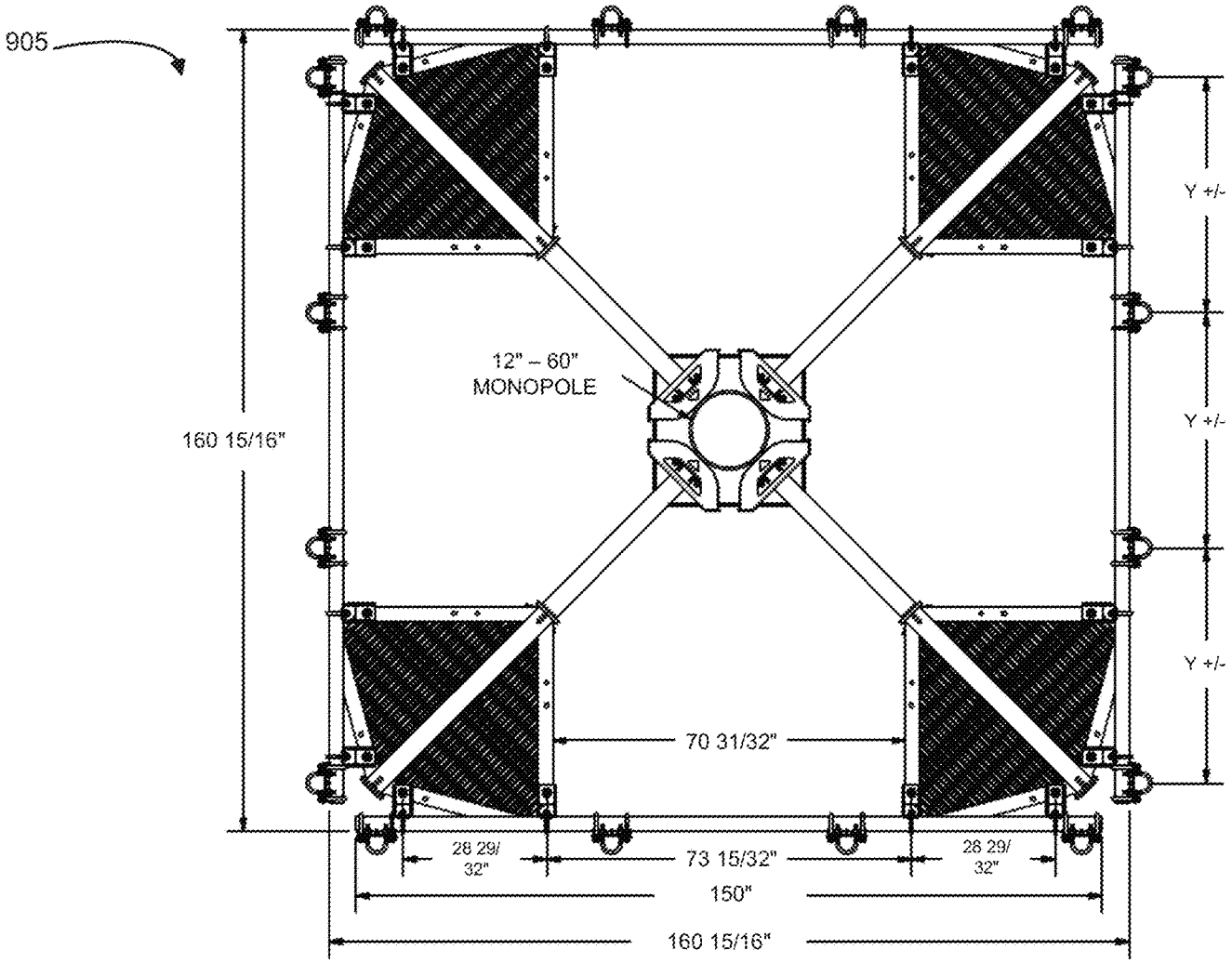
FIG. 10 illustrates an overhead view of the alternative monopole platform design of shown in FIG. 9.
Figure 11:
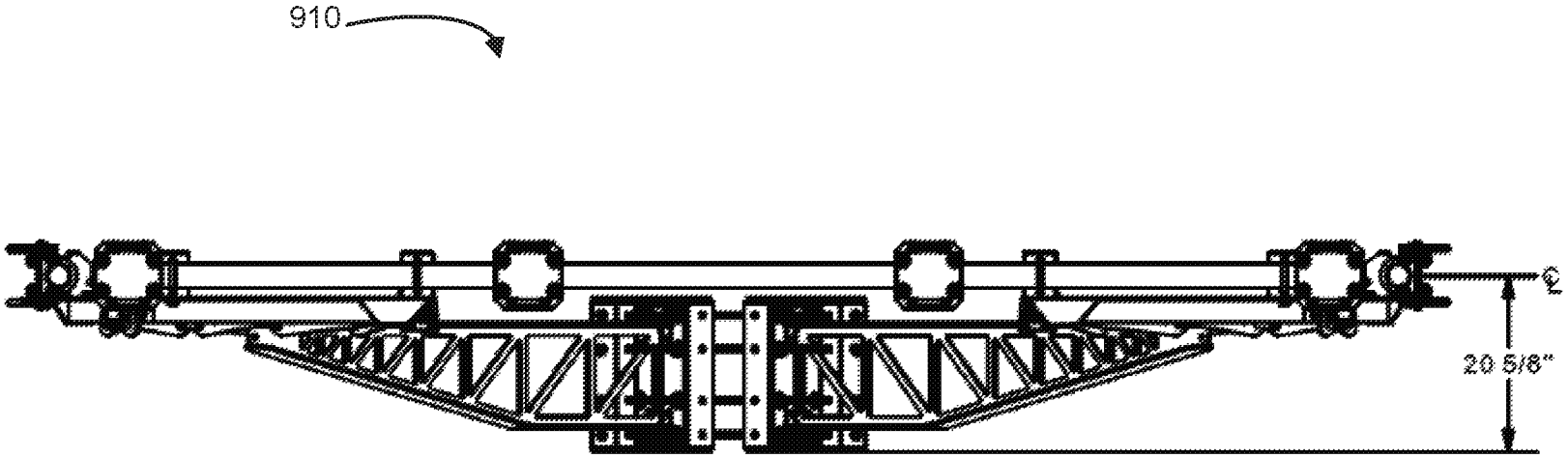
FIG. 11 illustrates a side view of the alternative monopole platform design of shown in FIG. 9.

As shown in FIG. 9, according to alternative preferred embodiments, the platform 900 of the present invention may further include four face pipes 65, 67, 68, 69 which are secured together via four central connection plates 70, 71, 72, 73 and four corner platforms 74, 75, 76, 77 to form a generally rectangular shape. Further, the present invention as shown in FIGS. 9-11 may preferably further include four platform inserts (not shown) which may be secured and attached as discussed above with respect to FIGS. 5-8. FIG. 10 illustrates an overhead view of the alternative monopole platform design 905 as shown in FIG. 9. Further, FIG. 11 illustrates a side view of the alternative monopole platform design of shown in FIG. 9.

Figure 12:
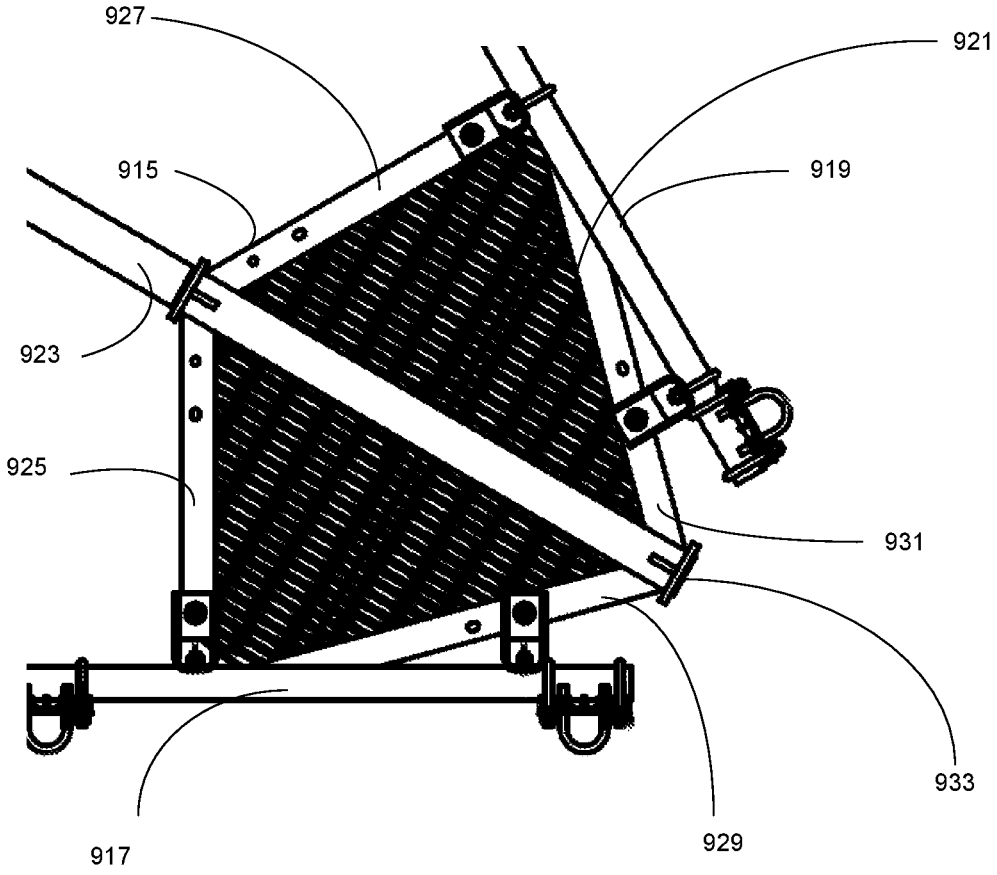
FIG. 12 illustrates an enlarged, underside view of an exemplary corner platform.

Referring now to FIG. 12, an enlarged, underside view of an exemplary corner platform 915 shall now be discussed. As shown, the example corner platform 915 is attached between a pair of face pipes 917, 919 with a side arm joist 923 extending across the under-surface of the corner platform 915. The corner platform 915 may include inner side-surfaces 925, 927 and outer side-surfaces 929, 931. The two inner side-surfaces 925, 927 are located nearer to the central securing pole (not shown) and the two outer side-surfaces 929, 931 are located further away from the central securing pole. Together, these side surfaces 925, 927, 929, 931 preferably together enclose the corner platform supporting surface 921.

According to preferred embodiments, the two outer side-surfaces 929, 931 are preferably arranged and/or connected to form an interior angle greater than 90°. Likewise, the two inner side-surfaces 925, 927 may be arranged and/or connected to form an interior angle which also exceeds 90°. The distal end surface 933 of the central side arm joist 923 is unattached to either adjacent face pipe 917, 919. According to a preferred embodiment, the distal end surface 933 may preferably extend beyond the connection point of the outer side surfaces 929, 931. Further, the distal end surfaces 933 of each side arm joist 32, 30, 33 may preferably be oriented so that the front axis of the distal end surfaces 933 face way from each of the surrounding face pipes 65, 67, 68, 69 (as shown in FIG. 9).

The above description of the illustrated embodiments of the present invention is not intended to be exhaustive or to limit the present invention to the precise form disclosed. While specific embodiments of, and examples for, the present invention are described herein for illustrative purposes, various equivalent modifications are possible within the scope of the systems and methods, as those skilled in the relevant art will recognize. The teachings provided herein can be applied to other physical arrangements, not only the arrangements described above. The elements and acts of the various embodiments described above can be combined to provide further embodiments. These and other changes can be made in light of the above detailed descriptions.

In general, in the following claims, the terms used should not be construed to limit the systems and methods to the specific embodiments disclosed in the specification and the claims but should be construed to include all processing systems that operate under the claims. Accordingly, the systems and methods are not limited by the disclosure, but instead the scope of the systems and methods is to be determined entirely by the claims.

While certain aspects of the systems and methods are presented below in certain claim forms, the inventor contemplates the various aspects of the systems and methods in any number of claim forms. Accordingly, the inventor reserves the right to add additional claims after filing the application to pursue such additional claim forms for other aspects of the systems and methods.

What is claimed is:

1. An adjustable tower platform apparatus, the apparatus comprising:

a first face pipe having a first end and a second end;

a second face pipe having a first end and a second end;

a third face pipe having a first end and a second end;

a first corner platform, wherein the first corner platform comprises a first inner side surface, a second inner side surface, a first outer side surface, and a second outer side surface; wherein the first inner side surface forms a first acute angle with the first outer side surface; wherein the second inner side surface forms a second acute angle with the second outer side surface;

wherein the first inner side surface is off-set from the second inner side surface;

wherein the first corner platform is attached to the first end of the first face pipe and to the second end of the second face pipe; wherein the first face pipe is attached to the first outer side surface of the first corner platform by a first bracket; wherein the first outer side surface is not parallel to the first face pipe; wherein the second face pipe is attached to the second outer side surface of the first corner platform by a second bracket; wherein the second outer side surface of the first corner platform is not parallel to the second face pipe; further wherein the first corner platform is undergirded by a first side arm joist; wherein the first side arm joist is connected to a first connection plate;

a second corner platform, wherein the second corner platform is attached to the first end of the second face pipe and to the second end of the third face pipe; wherein the second face pipe is attached to a first outer side surface of the second corner platform by a third bracket; wherein the first outer side surface of the second platform is not parallel to the second face pipe; wherein the third face pipe is attached to a second outer side surface of the second corner platform by a fourth bracket; wherein the second outer side surface of the second corner platform is not parallel to the third face pipe; further wherein the second corner platform is undergirded by a second side arm joist; wherein the second side arm joist is connected to a second connection plate; and a third corner platform, wherein the third corner platform is attached to the first end of the third face pipe and to the second end of the first face pipe; wherein the third face pipe is attached to a first outer side surface of the third corner platform by a fifth bracket; wherein the first outer side surface of the third platform is not parallel to the third face pipe; wherein the first face pipe is attached to a second outer side surface of the third corner platform by a sixth bracket; wherein the second outer side surface of the third corner platform is not parallel to the first face pipe; further wherein the third corner platform is undergirded by a third side arm joist; wherein the third side arm joist is connected to a third connection plate;

wherein the first, second and third connection plates each comprise a left supporting arm, a central connecting surface, a right supporting arm, a top surface and a bottom surface; wherein the right arm of the first connection plate is adjustably secured to the left arm of the second connection plate; wherein the right arm of the second connection plate is adjustably secured to the left arm of the third connection plate; wherein the right arm of the third connection plate is adjustably secured to the left arm of the first connection plate; wherein the first, second and third connection plates are adjustably secured with a plurality of connecting bolts; wherein each of the plurality of connecting bolts extend through at least a portion of two of the first, second and third connection plates;

wherein the first side arm joist undergirding the first corner platform comprises a distal end surface; wherein the front axis of the distal end surface is oriented to not intersect with an outer surface of any face pipe;

wherein at least one end of the first face pipe is directly adjacent to at least one end of the second face pipe so that no other face pipe is between the at least one end of the first face pipe and the at least one end of the second face pipe.

2. The apparatus of claim 1, wherein the first face pipe comprises a plurality of cross-over plates.

3. The apparatus of claim 2, wherein the first side arm joist is substantially orthogonal to the central connecting surface of the first central connection plate; wherein the first side arm joist is bolted to the central connecting surface of the first central connection plate.

4. The apparatus of claim 3, wherein the second side arm joist is substantially orthogonal to the central connecting surface of the second central connection plate; wherein the second side arm joist is bolted to the central connecting surface of the second central connection plate.

5. The apparatus of claim 4, wherein the third side arm joist is substantially orthogonal to the central connecting surface of the third central connection plate; wherein the third side arm joist is bolted to the central connecting surface of the third central connection plate.

6. The apparatus of claim 5, wherein the apparatus comprises a first central platform section; wherein the first central platform section comprises a substantially planar surface.

7. The apparatus of claim 6, wherein the first central platform section comprises a grated surface.

8. The apparatus of claim 7, wherein the first central platform section is rotationally attached to the first face pipe.

9. The apparatus of claim 8, wherein the first central platform section comprises a plurality of first central platform securing flanges; wherein the plurality of first central platform securing flanges extend laterally out from the planar surface of the first central platform.

10. The apparatus of claim 9, wherein the first central platform is movable between a first position and a second position; wherein the first central platform is substantially perpendicular to first corner platform when the first central platform is in the first position; wherein the first central platform is substantially parallel to the first corner platform when the first central platform is in the second position.

11. The apparatus of claim 10, wherein at least one of the first central platform securing flanges is in contact with the first corner platform when the first central platform is in the second position; wherein at least one of the first central platform securing flanges is in contact with second corner platform when the first central platform is in the second position.

12. The apparatus of claim 11, wherein the apparatus comprises a second central platform section; wherein the second central platform section comprises a substantially planar surface.

13. The apparatus of claim 12, wherein the second central platform section is rotationally attached to the second face pipe; wherein the second central platform section comprises a plurality of second central platform securing flanges; wherein the plurality of second central platform securing flanges extend laterally out from the planar surface of the second central platform.

14. The apparatus of claim 13, wherein the second central platform is movable between a third position and a fourth position; wherein the second central platform is substantially perpendicular to first corner platform when the second central platform is in the third position; wherein the second central platform is substantially parallel to the first corner platform when the second central platform is in the fourth position.

15. The apparatus of claim 14, wherein at least one of the second central platform securing flanges is in contact with the second corner platform when the second central platform is in the third position; wherein at least one of the second central platform securing flanges is in contact with third corner platform when the second central platform is in the fourth position.

16. The apparatus of claim 15, wherein the apparatus comprises a third central platform section; wherein the third central platform section comprises a substantially planar surface.

17. The apparatus of claim 16, wherein the third central platform section comprises a grated surface; wherein the third central platform section is rotationally attached to the third face pipe.

18. The apparatus of claim 17, wherein the third central platform section comprises a plurality of third central platform securing flanges; wherein the plurality of third central platform securing flanges extend laterally out from the planar surface of the third central platform.

19. The apparatus of claim 18, wherein the third central platform is movable between a fifth position and a sixth position; wherein the third central platform is substantially perpendicular to first corner platform when the third central platform is in the fifth position; wherein the third central platform is substantially parallel to the first corner platform when the third central platform is in the sixth position; wherein at least one of the third central platform securing flanges is in contact with the third corner platform when the third central platform is in the sixth position; wherein at least one of the third central platform securing flanges is in contact with first corner platform when the third central platform is in the sixth position.

20. An adjustable tower platform apparatus for use with a monopole, the apparatus comprising:

a first face pipe having a first end and a second end;

a second face pipe having a first end and a second end;

a third face pipe having a first end and a second end;

a fourth face pipe having a first end and a second end;

a first corner platform, wherein the first corner platform comprises a first outer rear surface, a second outer rear surface, a first outer side surface, and a second outer side surface; wherein the first outer rear surface forms an acute angle with the first outer side surface; wherein the second outer rear surface forms an acute angle with the second outer side surface;

wherein the first outer side surface is off-set from the second outer side surface;

wherein the first corner platform is attached to the first end of the first face pipe and to the second end of the fourth face pipe; wherein the first face pipe is attached to the first outer side surface of the first corner platform by a first bracket; wherein the first outer side surface is not parallel to the first face pipe;

wherein the fourth face pipe is attached to the second outer side surface of the first corner platform by a second bracket; wherein the second outer side surface of the first corner platform is not parallel to the fourth face pipe; further wherein the first corner platform is undergirded by a first side arm joist; wherein the first side arm joist is connected to a first connection plate;

a second corner platform, wherein the second corner platform is attached to the second end of the first face pipe and to the first end of the second face pipe; wherein the first face pipe is attached to a first outer side surface of the second corner platform by a third bracket; wherein the first outer side surface of the second corner platform is not parallel to the first face pipe; wherein second face pipe is attached to a second outer side surface of the second corner platform by a fourth bracket; wherein the second outer side surface of the second corner platform is not parallel to the second face pipe; further wherein the second corner platform is undergirded by a second side arm joist; wherein the second side arm joist is connected to a second connection plate;

a third corner platform, wherein the third corner platform is attached to the second end of the second face pipe and to the first end of the third face pipe; wherein the second face pipe is attached to a first outer side surface of the third corner platform by a fifth bracket; wherein the first outer side surface of the third corner platform is not parallel to the second face pipe; wherein third face pipe is attached to a second outer side surface of the third corner platform by a sixth bracket; wherein the second outer side surface of the third corner platform is not parallel to the third face pipe; further wherein the third corner platform is undergirded by a third side arm joist; wherein the third side arm joist is connected to a third connection plate;

a fourth corner platform, wherein the fourth corner platform is attached to the second end of the third face pipe and to the first end of the fourth face pipe; wherein the third face pipe is attached to a first outer side surface of the fourth corner platform by a seventh bracket; wherein the first outer side surface of the fourth corner platform is not parallel to the third face pipe; wherein the fourth face pipe is attached to a second outer side surface of the fourth corner platform by an eighth bracket; wherein the second outer side surface of the fourth corner platform is not parallel to the fourth face pipe; further wherein the fourth corner platform is undergirded by a fourth side arm joist; wherein the fourth side arm joist is connected to a fourth connection plate;

wherein the first, second, third and fourth connection plates each comprise a left supporting arm, a central connecting surface, a right supporting arm, a top surface and a bottom surface;

wherein the right arm of the first connection plate is adjustably secured to the left arm of the second connection plate; wherein the right arm of the second connection plate is adjustably secured to the left arm of the third connection plate; wherein the right arm of the third connection plate is adjustably secured to the left arm of the fourth connection plate; wherein the right arm of the fourth connection plate is adjustably secured to the left arm of the first connection plate; wherein the first, second, third and fourth connection plates are adjustably secured with a plurality of connecting bolts; wherein each of the plurality of connecting bolts extend through at least a portion of two of the first, second, third and fourth connection plates;

wherein the first side arm joist undergirding the first corner platform comprises a distal end surface; wherein the front axis of the distal end surface is oriented to not intersect with an outer surface of any face pipe;

wherein at least one end of the first face pipe is directly adjacent to at least one end of the second face pipe so that no other face pipe is between the at least one end of the first face pipe and the at least one end of the second face pipe.

21. The apparatus of claim 20, wherein the apparatus comprises a first central platform section; wherein the first central platform section comprises a substantially planar surface; wherein the first central platform section is rotationally attached to the first face pipe; wherein the first central platform section comprises a plurality of first central platform securing flanges; wherein the plurality of first central platform securing flanges extend laterally out from the planar surface of the first central platform; wherein the first central platform is movable between a first position and a second position; wherein the first central platform is substantially perpendicular to first corner platform when the first central platform is in the first position; wherein the first central platform is substantially parallel to the first corner platform when the first central platform is in the second position; wherein at least one of the first central platform securing flanges is in contact with the first corner platform when the first central platform is in the second position; wherein at least one of the first central platform securing flanges is in contact with second corner platform when the first central platform is in the second position.

22. The apparatus of claim 21, wherein the apparatus comprises a second central platform section; wherein the second central platform section comprises a substantially planar surface; wherein the second central platform section is rotationally attached to the second face pipe; wherein the second central platform section comprises a plurality of second central platform securing flanges; wherein the plurality of second central platform securing flanges extend laterally out from the planar surface of the second central platform.

23. The apparatus of claim 22, wherein the second central platform is movable between a third position and a fourth position; wherein the second central platform is substantially perpendicular to first corner platform when the second central platform is in the third position; wherein the second central platform is substantially parallel to the first corner platform when the second central platform is in the fourth position.

* * * * *